US009854861B2

(12) United States Patent
Covelli et al.

(10) Patent No.: US 9,854,861 B2
(45) Date of Patent: Jan. 2, 2018

(54) GARMENT BANDS INCLUDING POLYMER COMPOSITIONS

(75) Inventors: Carmen A. Covelli, Chadds Ford, PA (US); Douglas K. Farmer, Greensboro, NC (US); Becky J. Rose, Blair, OK (US); Gregory P. Weeks, Hockessin, DE (US)

(73) Assignee: INVISTA North America S.a.r.l., Wilmington, DE (US)

( * ) Notice: Subject to any disclaimer, the term of this patent is extended or adjusted under 35 U.S.C. 154(b) by 1151 days.

(21) Appl. No.: 12/990,032

(22) PCT Filed: May 1, 2009

(86) PCT No.: PCT/US2009/042575

§ 371 (c)(1),
(2), (4) Date: Oct. 28, 2010

(87) PCT Pub. No.: WO2009/135155

PCT Pub. Date: Nov. 5, 2009

(65) Prior Publication Data

US 2011/0041232 A1 Feb. 24, 2011

Related U.S. Application Data

(60) Provisional application No. 61/049,575, filed on May 1, 2008.

(51) Int. Cl.
*A41F 9/00* (2006.01)
*A41D 27/02* (2006.01)

(52) U.S. Cl.
CPC ..... *A41F 9/00* (2013.01); *A41D 27/02* (2013.01)

(58) Field of Classification Search
CPC ..... A41F 9/00; A41D 27/02
USPC ..... 2/69, 239, 109, 161.7; 524/589
See application file for complete search history.

(56) References Cited

U.S. PATENT DOCUMENTS

| | | | | |
|---|---|---|---|---|
| 5,728,340 | A * | 3/1998 | Dreibelbis et al. | 264/216 |
| 6,389,602 | B1 * | 5/2002 | Alsaffar | 2/161.7 |
| 6,546,564 | B1 | 4/2003 | Palmer | |
| 7,240,371 | B2 * | 7/2007 | Liu et al. | 2/69 |
| 8,058,343 | B2 * | 11/2011 | Liu et al. | 524/591 |
| 2005/0186879 | A1 * | 8/2005 | Martin | 442/327 |
| 2006/0183849 | A1 * | 8/2006 | Liu et al. | 524/589 |
| 2006/0183850 | A1 * | 8/2006 | Liu et al. | 524/589 |
| 2006/0183851 | A1 * | 8/2006 | Liu et al. | 524/589 |
| 2006/0183852 | A1 * | 8/2006 | Liu et al. | 524/591 |
| 2007/0117953 | A1 * | 5/2007 | Palmer, Jr. | 528/85 |
| 2007/0264462 | A1 * | 11/2007 | Covelli et al. | 428/43 |
| 2008/0004395 | A1 * | 1/2008 | Covelli et al. | 524/591 |

(Continued)

FOREIGN PATENT DOCUMENTS

| | | |
|---|---|---|
| JP | 1997273007 | 10/1997 |
| JP | 2005113349 | 4/2005 |

(Continued)

OTHER PUBLICATIONS

S. Siggia, "Quantitative Organic Analysis via Functional Group", 3rd Edition, Wiley & Sons, NY, p. 559-561, 1963.

*Primary Examiner* — Richale Quinn
(74) *Attorney, Agent, or Firm* — Bridget C. Sciamanna

(57) ABSTRACT

Articles comprising garments with at least one opening layers are included. The articles may include an elastic polymer composition such as a film, a melt or an aqueous dispersion.

21 Claims, 3 Drawing Sheets

(56) References Cited

U.S. PATENT DOCUMENTS

| | | | | |
|---|---|---|---|---|
| 2009/0088037 | A1* | 4/2009 | Covelli et al. | 442/76 |
| 2009/0181599 | A1* | 7/2009 | Farmer et al. | 450/39 |
| 2012/0036616 | A1* | 2/2012 | Miyasaka | 2/239 |

FOREIGN PATENT DOCUMENTS

| | | |
|---|---|---|
| JP | 2007177359 | 7/2007 |
| JP | 2008530308 | 8/2008 |
| KR | 1020010033523 | 4/2001 |
| KR | 0750458 | 8/2007 |

* cited by examiner

GARMENT BANDS INCLUDING POLYMER COMPOSITIONS

BACKGROUND OF THE INVENTION

Field of the Invention

The present invention relates to articles which are garments that have at least one opening and include a polymer composition, such as a polyurethaneurea, a polyurethane, or a polyolefin. The polymer composition provides many benefits to the garment opening including stretch recovery/elasticity and shape retention among others.

Summary of Related Technology

Interfacing is a woven or non-woven material that can be used in garment manufacture to provide stiffness to garment edge bands, such as waistbands, cuffs, and collars. However, these are generally not stretchable/elastic and therefore restrict the ability of the finished garment edging to stretch and recover. Some degree of stretch in waistbands and other garment openings is desirable to enhance comfort of the garment wearer.

Another example of an edge band is found in hosiery such as thigh high hosiery. Although they are similar to stockings, thigh-high hosiery may be used without the need for a garter belt. Most thigh-highs include a silicone rubber elastomeric film which is applied to the inner skin contacting surface of the thigh-high. The silicone film is typically applied as two thin strips of 0.25 to 0.5 inches in width or as a single strip of 0.75 to 1.25 inches in width. One desirable configuration includes the use of lace at the opening where the silicone is applied as a liquid and dried to the lace band which is then attached to a greige hosiery leg which is then dyed and finished.

Polymer compositions such as polyurethaneurea films and tapes that provide stretch recovery are disclosed in U.S. Pat. No. 7,240,371. Other examples of polymer compositions are polyurethane tapes such as those commercially available from Bemis, and polyolefin resins that can be formed into films such as those commercially available from ExxonMobil under the trade name VISTAMAXX. These films may be bonded to fabric with application of heat.

There is a need for alternative fabric constructions that avoid the need for interfacing or silicone rubber which maintain the shape and provide elasticity, such as the elasticity of polyurethaneurea.

SUMMARY OF THE INVENTION

Figure 1:
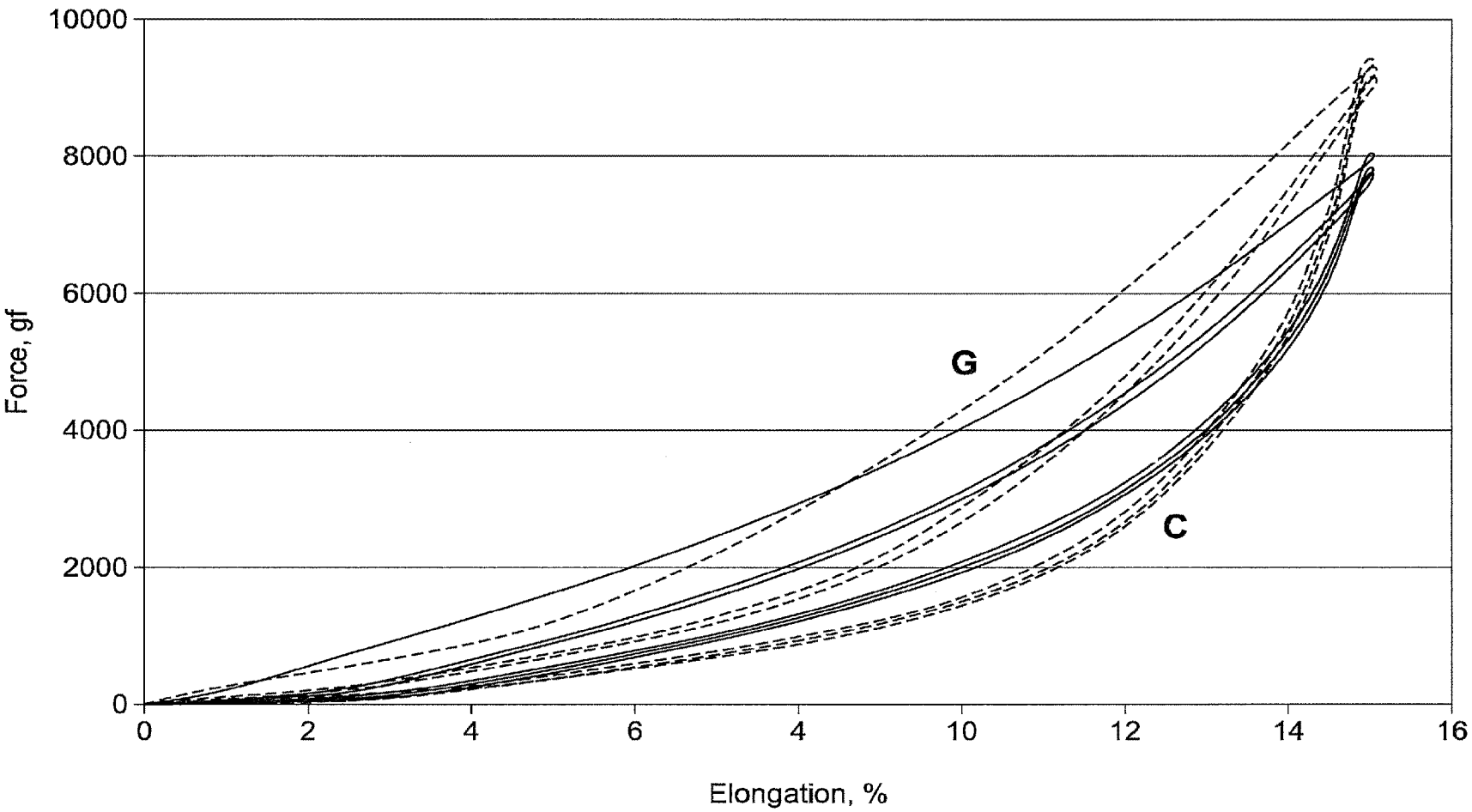
FIGS. 1, 2 and 3 are a graphs showing stress-strain comparison of fabrics including polyurethaneurea films compared to fabrics including interface.

In some embodiments are garments including multiple layer materials including at least one fabric layer and at least one layer of elastomeric polymer film such as a polyurethane, polyurethaneurea (PUU), or a polyolefin. Included is an article including a garment having at least one opening; wherein the circular opening including a polyurethaneurea composition. The polyurethaneurea may be in any suitable form including a film, and dispersion and combinations thereof.

The fusible, heat-activated polymeric elastic films are included in multiple layer constructions and may be attached by a variety of methods including heat/bonding, with the use of an adhesive, or by sewing. The fabric of the multiple layer construction may be woven, knit or non-woven. The polymer composition may be applied as a film, a melt or a dispersion. The polymer compositions may be used in an edge band either with or without interfacing in a variety of garments constructions including waistbands, collars, cuffs, leg openings (leg bands), hems, armbands (i.e., gloves or sleeves) or in combination when the garment has more than one opening. Generally, the openings will be substantially circular or form a band. The opening itself may be circular or including an opening such as a waistband or a glove for use when donning the article.

The fabric itself may or may not be a stretch fabric. The inclusion of the polyurethaneurea composition imparts benefits of elasticity and shape retention to either type of fabric.

DETAILED DESCRIPTION OF THE INVENTION

As used herein, the term "film" means a flat, generally two-dimensional article. The film may be self-supporting such as a film that has been cast and dried or extruded. Alternatively, the film may be a melt, dispersion or solution.

As used herein, the term "porous" refers to a substrate that includes voids or holes in the surface or at any point within or through the thickness of the substrate or to any material of which the articles of the present invention may come into contact.

As used herein, the term "pressing" or "pressed" refers to an article that has been subjected to heat and/or pressure to provide a substantially planar structure.

As used herein, the term "foam" refers to any suitable foam that may be used in fabric construction such as polyurethane foam.

As used herein, the term "dispersion" refers to a system in which the disperse phase consists of finely divided particles, and the continuous phase can be a liquid, solid or gas.

As used herein, the term "aqueous polyurethane dispersion" refers to a composition containing at least a polyurethane or polyurethane urea polymer or prepolymer (such as the polyurethane prepolymer described herein), optionally including a solvent, that has been dispersed in an aqueous medium, such as water, including de-ionized water.

As used herein, the term "solvent," unless otherwise indicated, refers to a non-aqueous medium, wherein the non-aqueous medium includes organic solvents, including volatile organic solvents (such as acetone) and somewhat less volatile organic solvents (such as MEK, or NMP).

As used herein, the term "solvent-free" or "solvent-free system" refers to a composition or dispersion wherein the bulk of the composition or dispersed components has not been dissolved or dispersed in a solvent.

As used herein, the term "article" refers to an article which comprises a dispersion or shaped article and a substrate, for example a textile fabric, which may or may not have at least one elastic property, in part, due to the application of a dispersion or shaped article as described herein. The article may be in any suitable configuration such as one-dimensional, two-dimensional and/or three-dimensional.

As used herein, the term "fabric" refers to a knitted, woven or nonwoven material. The knitted fabric may be flat knit, circular knit, warp knit, narrow elastic, and lace. The woven fabric may be of any construction, for example sateen, twill, plain weave, oxford weave, basket weave, and narrow elastic. The nonwoven material may be meltblown, spun bonded, wet-laid, carded fiber-based staple webs, and the like.

As used herein, the term "substrate" refers to any material to which the articles of the present invention may come into contact. A substrate can be substantially one dimensional as is a fiber, two dimensional as in a planar sheet, or a three dimensional article or a bumpy sheet. A planar sheet for example may comprise textile fabric, paper, flocked article, and web. A three dimensional article for example may comprise leather and foam. Other substrates may comprise wood, paper, plastic, metal, and composites such as concrete, asphalt, gymnasium flooring, and plastic chips.

As used herein, the term "hard yarn" refers to a yarn which is substantially non-elastic.

As used herein, the term "molded" article refers to a result by which the shape of an article or shaped article is changed in response to application of heat and/or pressure.

As used herein, the term "derived from" refers to forming a substance out of another object. For example, a film may be derived from a dispersion which can be dried.

As used herein, the term "modulus" refers to a ratio of the stress on an item expressed in force per unit linear density or area.

In some embodiments are articles including a garment that has at least one opening that may be include an edgeband that includes an elastomeric polymer composition. Such garments may include tops, bottoms, hosiery, seamless garments, headwear, underwear and gloves.

A variety of different polyurethane compositions are useful with the films, solutions and dispersions of some embodiments. For example, the films of the some embodiments may be cast from a solution, an aqueous dispersion, or a substantially solvent free aqueous dispersion. Many such solutions or dispersions are known in the art such as those shown in U.S. Pat. No. 7,240,371. An example of a polyurethaneurea solution is a spinning solution from a commercial spandex production line may be used to cast a film, according to some embodiments of the present invention. Specific examples of aqueous dispersions and films cast from them which are useful with the present invention are described hereinbelow.

Generally, a polyurethane is the reaction product of a polymeric glycol with a diisocyanate that is chain extended with a diol, or for a polyurethaneurea, the chain extender is water or a diamine.

Polyurethane films are commercially available from Bemis Associates, Inc. of Shirley, Mass. Elastomeric polyolefin films include those prepared from metallocene-catalyzed polypropylene resins which are commercially available under the trade name VISTAMAXX from ExxonMobil Chemical of Houston, Tex.

In some embodiments is an article including a garment having at least one opening. The opening is also referred to as an edgeband. The edgeband may be included with a variety of different garments that include, but are not limited to, waistbands, cuffs and other arm openings and armbands, collars/neck openings, headbands, thigh highs, sock tops (the opening of a sock), leg warmers, wristbands, headbands, leg openings (legbands), and hems, among others. The polymer film may be attached to a surface of the opening, such as the inner body contacting surface, or may be included with a multiple layer opening, such as a single foldover of fabric or a multiple layered fabric construction such as a waistband. In multiple layer edge bands, the elastomeric polymer composition may be an intermediate layer or may be included on a fabric surface, including a body-contacting surface.

Methods of providing shape retention and flexibility as well as acting as a replacement for interfacing are also provided. These methods include bonding, adhering or sewing a polymer film to an edge band. The film may be exposed on a single side of an edgeband or may be included between two or more layers of fabric.

In another embodiment, a single layer of a fabric may be folded to form two or more layers of a multiple layer article with an elastomeric polymer composition such as a film or dispersion as an intermediate layer. In this embodiment, the article may then also be molded or pressed to a desired shape. Where a tape is placed at the point of folding, the tape may provide additional stretch recovery power, such as at a hem, or for a body shaping garment, to provide additional support.

Any type of fabric may be used as the edgebands of some embodiments. This includes woven, nonwoven, knit, and lace fabrics, among others. The elastomeric polymer film may be placed adjacent to one surface of the edgeband or between layers within the edgeband. The edgeband may be prepared separately and sewn to the garment opening or the polyurethaneurea composition may be incorporated into the garment opening during construction of the garment. Dyeing and finishing of the garment may be conducted before or after assembly of the garment including the edgeband with the elastomeric polymer composition.

A woven fabric that includes only rigid or hard yarns that have little or no stretch such as cotton, nylon, polyester and acrylic can also benefit from the stretch recovery and shape retention properties of the films of some embodiments. Although woven fabrics without elastic yarns such as spandex or polyester bicomponent fiber have minimal or no stretch in the direction of the yarns (the warp and weft), these fabric do have stretch along the bias, of the fabric, i.e., at an angle bisecting the intersection of the intersection of the warp and weft yarns. A fabric cut along the bias may then be used in an edgeband with a polymer film either on one side of the bias-cut fabric or between two layers of fabric, including where the film is between a folded fabric or between two separate layers of fabric.

There are some benefits to including the edgeband and polymer composition prior to fabric finishing. One examples is where in a waistband, fabrics, including 100% cotton fabrics, tend to shrink upon fabric finishing. During wear of the garment, growth tends to occur. By including a elastomeric polymer film in the waistband, growth of the fabric is resisted in addition to the benefits of added elasticity and vertical stability. For hosiery, such as thigh highs, garment dyeing and finishing processes improve the elastic properties including the modulus of the polymeric film composition, especially where the film includes polyurethaneurea.

In some embodiments are garments such as a waistband where the film/tape placement can provide vertical stability and stretch recovery to prevent the waistband from rolling or folding, while enhancing comfort. This is in contrast to the use of interfacing in a garment waistband which also improves vertical stability but is stiff. In a waistband, the elastomeric polymer composition also provides the benefit of maintaining placement of the edgeband with respect to the wearer's body. For example, gaping of a waistband in pants including denim jeans (either with or without stretch), can expose the wearer's undergarments or portions of the wearer's posterior that the wearer prefers to be covered by the garment. By including the elastomeric polymer composition in the waistband of pants and jeans, the gaping is reduced or eliminated.

In an embodiment that includes a garment edge band of two or more layers, the elastomeric polymer composition may form the body contacting layer, or the innermost layer of the garment that may contact the skin of the wearer. Including the elastomeric polymer composition on a body contacting surface forms many advantageous functions. For example, the elastomeric polymer composition may provide an anchor or area of increased friction to reduce the relative movement between the article including the elastomeric polymer composition and an external substrate. This is particularly useful when the article is an undergarment including a skin-contacting surface (where the wearer's skin is the substrate). Other examples include hosiery such as socks and thigh highs. Alternatively, the substrate may be outer clothing which is in contact with the elastomeric polymer composition of the inventive article. Where the substrate is outer clothing of a wearer and the article is worn as an undergarment, the article prevents or reduces the relative movement of the outer garment. In addition, an outer garment (e.g. a dress) may include a elastomeric polymer composition to maintain the relative placement of an inner garment (e.g. a slip).

The processes to bond the elastomeric polymer composition to the fabric may vary. The elastomeric polymer composition may be applied directly as a dispersion, melt or solution, followed by cooling or drying or may be sewn into the garment or bonded when in a film form. For bonding, pressure, heat, or a combination of pressure and heat is applied to the garment. For example, heat may be applied at about 150° C. to about 200° C. or about 180° C. to about 190° C., including about 185° C. for a sufficient time to achieve a molded article. Suitable times for application of heat include, but are not limited to, from about 30 sec to about 360 sec including from about 45 sec to about 120 sec. Bonding may be effected by any known method, including but not limited to, microwave, infrared, conduction, ultrasonic, pressure application over time (i.e. clamping) and combinations thereof.

Due the application of heat and pressure to the articles including elastomeric polymer films or dispersion and given that films and fabrics are themselves porous materials, it is recognized that the film or dispersion may partially or completely impregnate the fabric or foam of the article. For example, the elastomeric polymer composition may form a layer which is partially separate from the surrounding layers, or may be completely transferred to the surrounding layer or layers to form an integrated article without a distinguishably separate elastomeric polymer composition layer. The films of some embodiments may be manually or mechanically altered to enhance porosity or may be perforated.

In order to add additional support and other features, the elastomeric polymer composition may be added to different areas of the article. For example, when a film is used, it may either extend through the entire area of the edgeband (continuous application) or to a selected portion or portions (discontinuous application) to provide different benefits. For example, pieces of elastomeric polymer composition may be placed in selected locations throughout the area of the opening or edge band.

Another advantage of the films cast from the aqueous dispersions of some embodiments is with respect to the feel or tactility of the films. They provide a softer feel compared to silicone rubber or the commercially available TPU films while maintaining the desired friction to reduce movement that is a further advantage for skin contact applications. Also lower bending modulus gives better drape and fabric hand. These advantages are readily apparent for uses of the elastomeric polymer films or dispersions in hosiery including socks, knee highs and thigh highs (where silicone rubber is the current commercial standard).

Depending on the desired effect of the polyurethaneurea composition of some embodiments when applied as a film or dispersion from the aqueous dispersion described herein, the weight average molecular weight of the polymer in the film may vary from about 40,000 to about 150,000, including from about 100,000 to about 150,000 and about 120,000 to about 140,000. Single or multiple layer polyurethaneurea compositions may be used. Alternatively, a polyurethaneurea composition may be used with an additional adhesive. Where the polyurethaneurea composition of some embodiments includes more than one polyurethaneurea layer, each polyurethaneurea layer may have a different weight average molecular weight. For example, where a polyurethaneurea composition includes more than one polyurethaneurea layer, at least one layer of polyurethaneurea may have a lower molecular weight of weight average molecular weight from about 35,000 to about 90,000, including from about 50,000 to about 80,000 and about 70,000; and a layer of polyurethaneurea having higher molecular weight of a weight average molecular weight from about 100,000 to about 140,000, including from about 110,000 to about 130,000 and about 120,000. Other examples are where a polyurethaneurea composition has at least a two layer configuration including one layer of lower molecular weight and one layer of higher molecular weight or the polyurethaneurea composition has at least a three layer configuration having at least one layer of higher molecular weight between two layers having a lower molecular weight. When a multiple layer polyurethaneurea film is used, the layer of lower molecular weight is generally more adhesive and can be selected as the side the contacts that garment prior to bonding. However, if the film is sewn or adhered with an adhesive, the bonding ability of the polyurethaneurea is less significant.

One suitable method for accomplishing the application of the elastomeric polymer composition to an article is to apply a dispersion or solution to a fabric The application may be by any of a variety of different methods. Methods for applying the dispersions or solutions of elastomeric polymer include spraying, kissing, printing, brushing, dipping, padding, dispensing, metering, painting, and combinations thereof. This may be followed by application of heat and/or pressure.

Other adhesives may be included in the multiple layer articles of some embodiments of the invention. Examples of adhesives include any hot melt adhesive, a cyanoacrylate, an epoxy, polyvinyl acetate, a plastisol (including rubber), a thermoplastic (including polyurethanes, polyesters, and polyamides), silicone, a polyurethaneurea aqueous dispersion, a thermoset, a pressure sensitive adhesive and combinations thereof. The adhesive may be used to adhere the elastomeric polymer composition to the garment by application of the adhesive to the elastomeric polymer composition (especially when in film form), to the fabric of the garment or both. The adhesive may include a continuous or discontinuous application. Examples of discontinuous application of adhesive include the group consisting of dots, vertical lines, horizontal lines, diagonal lines, a grid, and combinations thereof. An example of a commercially available hot melt adhesive in a dot configuration is available under the tradename Pinbond®, by Freudenberg Gygli GmbH, Weinheim, Germany and is useful for bonding elastic textiles. Moreover, the polyurethaneurea aqueous dispersions of some embodiments may also be used as an adhesive to adhere more than one layer of any the garment or elastomeric polymer film as described in some embodiments.

An adhesive may also be added to an elastomeric polymer composition to increase adhesion to a fabric substrate or garment, or to the skin of the wearer of the garment. Examples of adhesives include, but are not limited to, Silicones, such as pressure sensitive adhesives commercially available from Dow Corning. Such adhesives can be selected for properties such as varying tack levels (very high, high, medium and low tack); standard and amine-compatible; solvent and hot melt technologies.

Acrylics can also be used for enhancing adhesion. These include: pressure-sensitive acrylic adhesives for application to skin are made from 2-ethylhexyl acrylate, isooctyl acrylate or n-butyl acrylate copolymerized with polar functional monomers such as acrylic acid, methacrylic acid, vinyl acetate, methyl acrylate, N-vinylcaprolactam, or hydroxyethyl methacrylate. Functional comonomers increase cohesive strength, provide surface polarity, and enhance wear performance. Tack, adhesion to skin, adhesive transfer to skin, and wear performance of the adhesive are governed by the molecular weight, glass transition temperature, and the viscoelastic behavior of the adhesive.

Starches can also increase adhesion of the elastomeric polymer compositions of some embodiments. These include a variety of starches including from about 0 to 70% by weight amylose content.

A variety of different fibers and yarns may be used with the fabrics and garments of some embodiments. These include cotton, wool, acrylic, polyamide (nylon), polyester, spandex, regenerated cellulose, rubber (natural or synthetic), bamboo, silk, soy or combinations thereof.

Other additives that may be optionally included in the aqueous dispersion or in the prepolymer include: antioxidants, UV stabilizers, colorants, pigments, crosslinking agents, phase change materials (i.e., Outlast®, commercially available from Outlast Technologies, Boulder, Colo.), antimicrobials, minerals (i.e., copper), microencapsulated well-being additives (i.e., aloe vera, vitamin E gel, aloe vera, sea kelp, nicotine, caffeine, scents or aromas), nanoparticles (i.e., silica or carbon), calcium carbonate, flame retardants, antitack additives, chlorine degradation resistant additives, vitamins, medicines, fragrances, electrically conductive additives, and/or dye-assist agents (i.e., Methacrol®, commercially available from E.I. DuPont de Nemours, Wilmington, Del.). Other additives which may be added to the prepolymer or the aqueous dispersion comprise adhesion promoters, anti-static agents, anti-cratering agents, anti-crawling agents, optical brighteners, coalescing agents, electroconductive additives, luminescent additives, flow and leveling agents, freeze-thaw stabilizers, lubricants, organic and inorganic fillers, preservatives, texturizing agents, thermochromic additives, insect repellents, and wetting agents.

Such optional additives may be added to the aqueous dispersion before, during, or after the prepolymer is dispersed, as the process allows. No organic solvent is added to the aqueous dispersion at any time. Similarly, these additives may be included with any other elastomeric polymer composition including polyolefins and polyurethanes.

Polyurethane aqueous dispersions falling within the scope of the present invention should be expected to have a solids content of from about 10% to about 50% by weight, for example from about 30% to about 45% by weight. The viscosity of polyurethane aqueous dispersions falling within the scope of the present invention may be varied in a broad range from about 10 centipoises to about 100,000 centipoises depending on the processing and application requirements. For example, in one embodiment, the viscosity is in the range of about 500 centipoises to about 30,000 centipoises. The viscosity may be varied by using an appropriate amount of thickening agent, such as from about 0 to about 2.0 wt %, based on the total weight of the aqueous dispersion.

An organic solvent may also be used in the preparation of films and dispersions of some embodiments. The organic solvent may be used to lower the prepolymer viscosity through dissolution and dilution and/or to assist the dispersion of solid particles of the diol compound having a carboxylic acid group such as 2,2-dimethylopropionic acid (DMPA) to enhance the dispersion quality. It may also serve for the purposes to improve the film uniformity such as reducing streaks and cracks in the coating process.

The solvents selected for these purposes are substantially or completely non-reactive to isocyanate groups, stable in water, and have a good solubilizing ability for DMPA, the formed salt of DMPA and triethylamine, and the prepolymer. Examples of suitable solvents include N-methylpyrrolidone, N-ethylpyrrolidone, dipropylene glycol dimethyl ether, propylene glycol n-butyl ether acetate, N,N-dimethylacetamide, N,N-dimethylformamide, 2-propanone (acetone) and 2-butanone (methylethylketone or MEK).

The amount of solvent added to the films/dispersion of some embodiments may vary. When a solvent is include, suitable ranges of solvent include amounts of less than 50% by weight of the dispersion. Smaller amounts may also be used such as less than 20% by weight of the dispersion, less than 10% by weight of the dispersion, less than 5% by weight of the dispersion and less than 3% by weight of the dispersion.

There are many ways to incorporate the organic solvent into the dispersion at different stages of the manufacturing process, for example, 1) The solvent can be added to and mixed with the prepolymer after the polymerization is completed prior to transferring and dispersing the prepolymer, the diluted prepolymer containing the carboxylic acid groups in the backbone and isocyanate groups at the chain ends is neutralized and chain extended while it is dispersed in water.
2) The solvent can be added and mixed with other ingredients such as Terathane® 1800, DMPA and Lupranate® MI to make a prepolymer in the solution, and then this prepolymer containing the carboxylic acid groups in the backbone and isocyanate groups at the chain ends in the solution is dispersed in water and at the same time it is neutralized and chain extended.
3) The solvent can be added with the neutralized salt of DMPA and Triethylamine (TEA), and mixed with Terathane® 1800 and Lupranate® MI to make the prepolymer prior to dispersion.
4) The s solvent can be mixed with TEA, and then added to the formed prepolymer prior to dispersion.
5) The solvent can be added and mixed with the glycol, followed by the addition of DMPA, TEA and then Lupranate® MI in sequence to a neutralized prepolymer in solution prior to dispersion.

Films may be made by coating the dispersion onto a release paper and drying to remove water at temperatures below about 100° C. through commercially available processes to form a film on the paper. The formed film sheets can be slit into strips of desired width and wound-up into spools for later use in applications to form stretch articles, for example textile fabrics. Examples of such applications include: stitch-less or seamless garment constructions; seam seal and reinforcement; labels and patches bonding to garments; and localized stretch/recovery enhancement. The adhesion bonding can be developed in the temperature range of from about 100° C. to about 200° C., such as from about 130° C. to about 200° C., for example, from about 140° C. to about 180° C., in a period of 0.1 seconds to several minutes, for example, less than about one minute. Typical bonding machines are Sew Free (commercially available from SewSystems in Leicester, England), Macpi hemming machine (commercially available from the Macpi Group in Brescia, Italy), Framis hot air welding machine (commercially available from Framis Italy, s p.a. in Milano, Italy). This bonding is expected to be strong and durable when exposed to repeated wear, wash, and stretch in a textile fabric garment.

The coating, dispersion, or shaped article may be pigmented or colored and also may be used as a design element in that regard.

In addition, articles including an edgeband can be molded. For example, fabric can be molded under conditions appropriate for the hard yarn in the fabric. Also, molding may be possible at temperature which will mold the shaped article or dispersion, but below temperatures suitable for molding the hard yarn.

Lamination can be carried out to secure the polymer compositions to a fabric using any method wherein heat is applied to the laminate surface. Methods of heat application include, for example, ultrasonic, direct heat, indirect heat, and microwave. Such direct lamination may provide an advantage in view of other methods used in the art in that the shaped article may not only bond to the a substrate via a mechanical interaction but also via a chemical bond. For example, if the substrate has any reactive hydrogen functional groups, such groups may react with the isocyanate and hydroxyl groups on the dispersion or shaped article, thereby providing a chemical bond between the substrate and the dispersion or shaped article. Such chemical bonding of the dispersion or shaped article to the substrate can give a much stronger bond. Such bonding may occur in dry shaped articles that are cured onto a substrate or in wet dispersions that are dried and cured in one step. Materials without an active hydrogen include polypropylene fabrics and anything with a fluoropolymer or a silicone based surface. Materials with an active hydrogen include, for example, nylon, cotton, polyester, wool, silk, cellulosics, acetates, metals, and acrylics. Additionally, articles treated with acid, plasma, or another form of etching may have active hydrogens for adhesion. Dye molecules also may have active hydrogens for bonding.

Methods and means for applying the polymer compositions of some embodiments include, but are not limited to: roll coating (including reverse roll coating); use of a metal tool or knife blade (for example, pouring a dispersion onto a substrate and then casting the dispersion into uniform thickness by spreading it across the substrate using a metal tool, such as a knife blade); spraying (for example, using a pump spray bottle); dipping; painting; printing; stamping; and impregnating the article. These methods can be used to apply the dispersion directly onto a substrate without the need of further adhesive materials and can be repeated if additional/heavier layers are required. The dispersions can be applied to any fabrics of knits, wovens or nonwovens made from synthetic, natural, or synthetic/natural blended materials for coating, bonding, lamination and adhesion purposes. The water in the dispersion can be eliminated with drying during the processing (for example, via air drying or use of an oven), leaving the precipitated and coalesced polyurethane layer on the fabrics to form an adhesive bond.

At least one coagulant may optionally be used to control or to minimize penetration of dispersions according to the invention into a fabric or other article. Examples of coagulants that may be used include calcium nitrate (including calcium nitrate tetrahydrate), calcium chloride, aluminum sulfate (hydrated), magnesium acetate, zinc chloride (hydrated) and zinc nitrate.

An example of a tool that can be used for applying dispersions is a knife blade. The knife blade can be made of metal or any other suitable material. The knife blade can have a gap of a predetermined width and thickness. The gap may range in thickness, for example, from 0.2 mils to 50 mils, such as a thickness of 5 mils, 10 mils, 15 mils, 25 mils, 30 mils, or 45 mils.

The thickness of the elastomeric polymer films, solutions, and dispersions may vary depending on the application. In the case of dry shaped articles, the final thickness may, for example, range from about 0.1 mil to about 250 mil, such as from about 0.5 mil to about 25 mil, including from about 1 to about 6 mil (one mil=one thousandth of an inch).

Suitable thicknesses include about 0.5 mil to about 12 mil, about 0.5 to about 10 mil, and about 1.5 mil to about 9 mil. For aqueous dispersions, the amount used may, for example, range from about 2.5 $g/m^2$ to about 6.40 $kg/m^2$, such as from about 12.7 to about 635 $g/m^2$, including from about 25.4 to about 152.4 $g/m^2$.

Types of planar sheets and tapes that can be coated with dispersions and shaped articles falling within the scope of the present invention include, but are not limited to: textile fabrics, including wovens and knits; nonwovens; leather (real or synthetic); paper; metal; plastic; and scrim.

Non-elastic fabrics laminated or bonded to an elastomeric polymer film composition can have improved stretch and recovery and improved molding properties.

Examples of apparel or garments that include an opening that can be produced using the dispersions and shaped articles falling within the scope of the present invention, include but are not limited to: undergarments, brassieres, panties, lingerie, swimwear, shapers, camisoles, hosiery, sleepwear, wetsuits, scrubs, space suits, uniforms, hats, garters, sweatbands, belts, activewear, outerwear, rainwear, cold-weather jackets, pants, shirtings, dresses, blouses, mens and womens tops, sweaters, corsets, vests, knickers, socks, knee highs, thigh highs, dresses, blouses, aprons, tuxedos, bisht, abaya, hijab, jilbab, thoub, burka, cape, costumes, diving suit, kilt, kimono, jerseys, gowns, protective clothing, sari, sarong, skirts, spats, stola, suits, straitjacket, toga, tights, towel, uniform, veils, wetsuit, medical compression garments, bandages, suit interlinings, waistbands, and all components therein.

Another aspect of the invention is an article comprising the shaped article and a substrate wherein the shaped article and the substrate are attached to form a laminate whereby coefficient of friction of the elastic laminate is greater than that of the substrate alone. Examples of this are a waistband with a coating or film comprising the aqueous polyurethane dispersion which prevents slippage of the garment from another garment such as a blouse or shirt, or alternately prevents slippage of the waistband on the skin of the garment wearer.

Analytical Methods

Elongation, Tenacity, and Set

Elongation and tenacity properties were measured on films using a dynamic tensile tester Instron. The sample size was 1×3 inches (1.5 cm×7.6 cm) measured along the long dimension. The sample was placed in clamps and extended at a strain rate of 200% elongation per minute until a maximum elongation was reached. The tenacity and elongation were measured just prior to the film break. Similarly, the set % was measured by extending a 1×3 inches sample of film (1.5 cm×7.6 cm) from 0 to 50% elongation for five cycles at a strain rate of 200% per minute. The set % was measured after the fifth cycle.

EXAMPLES

Terathane® 1800 is a linear polytetramethylene ether glycol (PTMEG), with a number average molecular weight of 1,800 (commercially available from INVISTA S.à. r.L., of Wichita, Kans.);

Pluracol® HP 4000D is a linear, primary hydroxyl terminated polypropylene ether glycol, with a number average molecular weight of 400 (commercially available from BASF, Brussels, Belgium);

Mondur® mL is an isomer mixture of diphenylmethane diisocyanate (MDI) containing 50-60% 2,4'-MDI isomer and 50-40% 4,4'-MDI isomer (commercially available from Bayer, Baytown, Tex.);

Lupranate® MI is an isomer mixture of diphenylmethane diisocyanate (MDI) containing 45-55% 2,4'-MDI isomer and 55-45% 4,4'-MDI isomer (commercially available from BASF, Wyandotte, Mich.);

Isonate® 125MDR is a pure mixture of diphenylmethane diisocyanate (MDI) containing 98% 4,4'-MDI isomer and 2% 2,4'-MDI isomer (commercially available from the Dow Company, Midland, Mich.); and DMPA is 2,2-dimethylopropionic acid.

The following prepolymer samples were prepared with MDI isomer mixtures, such as Lupranate® MI and Mondur® ML, containing a high level of 2,4'-MDI.

Example 1

The preparation of the prepolymers was conducted in a glove box with nitrogen atmosphere. A 2000 ml Pyrex® glass reaction kettle, which was equipped with an air pressure driven stirrer, a heating mantle, and a thermocouple temperature measurement, was charged with about 382.5 grams of Terathane® 1800 glycol and about 12.5 grams of DMPA. This mixture was heated to about 50° C. with stirring, followed by the addition of about 105 grams of Lupranate® MI diisocyanate. The reaction mixture was then heated to about 90° C. with continuous stirring and held at about 90° C. for about 120 minutes, after which time the reaction was completed, as the % NCO of the mixture declined to a stable value, matching the calculated value (% NCO aim of 1.914) of the prepolymer with isocyanate end groups. The viscosity of the prepolymer was determined in accordance with the general method of ASTM D1343-69 using a Model DV-8 Falling Ball Viscometer (sold by Duratech Corp., Waynesboro, Va.) operated at about 40° C. The total isocyanate moiety content, in terms of the weight percent of NCO groups, of the capped glycol prepolymer was measured by the method of S. Siggia, "Quantitative Organic Analysis via Functional Group", 3rd Edition, Wiley & Sons, New York, pp. 559-561 (1963), the entire disclosure of which is incorporated herein by reference.

Example 2

The solvent-free prepolymer, as prepared according to the procedures and composition described in Example 1, was used to make the polyurethaneurea aqueous dispersion of the present invention.

A 2,000 ml stainless steel beaker was charged with about 700 grams of de-ionized water, about 15 grams of sodium dodecylbenzenesulfonate (SDBS), and about 10 grams of triethylamine (TEA). This mixture was then cooled with ice/water to about 5° C. and mixed with a high shear laboratory mixer with rotor/stator mix head (Ross, Model 100LC) at about 5,000 rpm for about 30 seconds. The viscous prepolymer, prepared in the manner as Example 1 and contained in a metal tubular cylinder, was added to the bottom of the mix head in the aqueous solution through flexible tubing with applied air pressure. The temperature of the prepolymer was maintained between about 50° C. and about 70° C. The extruded prepolymer stream was dispersed and chain-extended with water under the continuous mixing of about 5,000 rpm. In a period of about 50 minutes, a total amount of about 540 grams of prepolymer was introduced and dispersed in water. Immediately after the prepolymer was added and dispersed, the dispersed mixture was charged with about 2 grams of Additive 65 (commercially available from Dow Corning®, Midland Mich.) and about 6 grams of diethylamine (DEA). The reaction mixture was then mixed for about another 30 minutes. The resulting solvent-free aqueous dispersion was milky white and stable. The viscosity of the dispersion was adjusted with the addition and mixing of Hauthane HA thickening agent 900 (commercially available from Hauthway, Lynn, Mass.) at a level of about 2.0 wt % of the aqueous dispersion. The viscous dispersion was then filtered through a 40 micron Bendix metal mesh filter and stored at room temperatures for film casting or lamination uses. The dispersion had solids level of 43% and a viscosity of about 25,000 centipoises. The cast film from this dispersion was soft, tacky, and elastomeric.

Example 3

The preparation procedures were the same as Example 2, except that DEA was not added into the dispersion after the prepolymer was mixed. Initially, the dispersion appeared to be no different from Example 2. However, when the dispersion was aged at room temperatures for one week or more, the film cast from this dispersion was brittle and not suitable for adhesions or laminations.

Example 4

Several multi-layer articles were prepared as garment edge bands/waistbands and were tested for stretch and recovering according to the method described above; the results are shown in the Table 1. Each of the films listed as "PUU" in Table 1 are films cast and dried from the dispersion of Example 3.

TABLE 1

| Edgeband Preparation | | | | |
|---|---|---|---|---|
| Waistband | Liner Used | Fabric | Application | Garment Wash |
| A | Heat activated elastic film; PinBond and 3 mil PUU | 98/2 Cotton/spandex denim | Press 150 C./20 sec | YES |
| B | Heat activated elastic film; PinBond and 3 mil PUU | 98/2 Cotton/spandex denim, washed 3× Hot wash/Cotton Tumble Dry | Press 150 C./30 sec/5 bar | NO |
| C | Heat activated elastic film; PinBond and 3 mil PUU | Cotton/T-400 ® polyester bicomponent denim | Press 150 C./30 sec/5 bar | YES |
| D | Heat activated elastic film; PinBond and 3 mil PUU | Cotton/T-400 ® polyester bicomponent denim, washed 3× Hot wash/Cotton Tumble Dry | Press 150 C./30 sec/5 bar | NO |
| E | Interface | 98/2 Cotton/spandex denim | Sewn | YES |
| F | Interface | 98/2 Cotton/spandex denim, washed 3× Hot wash/Cotton Tumble Dry | Sewn | NO |
| G | Interface | Cotton/T-400 ® polyester bicomponent denim | Sewn | YES |
| H | Interface | Cotton/T-400 ® polyester bicomponent denim, washed 3× Hot wash/Cotton Tumble Dry | Sewn | NO |

Comparing Instron stress/strain for the waistbands that were garment washed, so an enhanced stretch (lower force at 15% elongation) and higher unload power for the waistbands made with current invention, using heat activated PUU elastic films. The fabrics were prepared from cotton and elastic polyester bicomponent. The comparison of stress/strain included the fabric with interface and the fabric with PUU elastic film as shown in FIG. 1.

Growth was tested by holding waistbands at 10% extension for 18 hours and measuring change 10" marked length, immediately and after 1 hour. Results are reported below. The description indicates the fabric composition and the use of the PUU film of Example 3 or interface.

TABLE 2

| Growth Data | | | |
|---|---|---|---|
| Waistband | Description | Growth, mm | Growth, 1 hr |
| C | Heat Activated PUU Film with Cotton/T-400 ® polyester bicomponent | 3.75 | 1.875 |
| G | Cotton/T-400 ® polyester bicomponent | 4.237 | 3.75 |
| A | Heat Activated PUU Film with Cotton/Spandex | 5 | 1.875 |
| E | Cotton/Spandex | 8.1 | 3.75 |

Both stretch and recovery are enhanced. The waistbands prepared with the heat activated PUU film are visibly smoother and flatter in appearance. The waistbands prepared with interface are wrinkled after washing.

Figure 2:
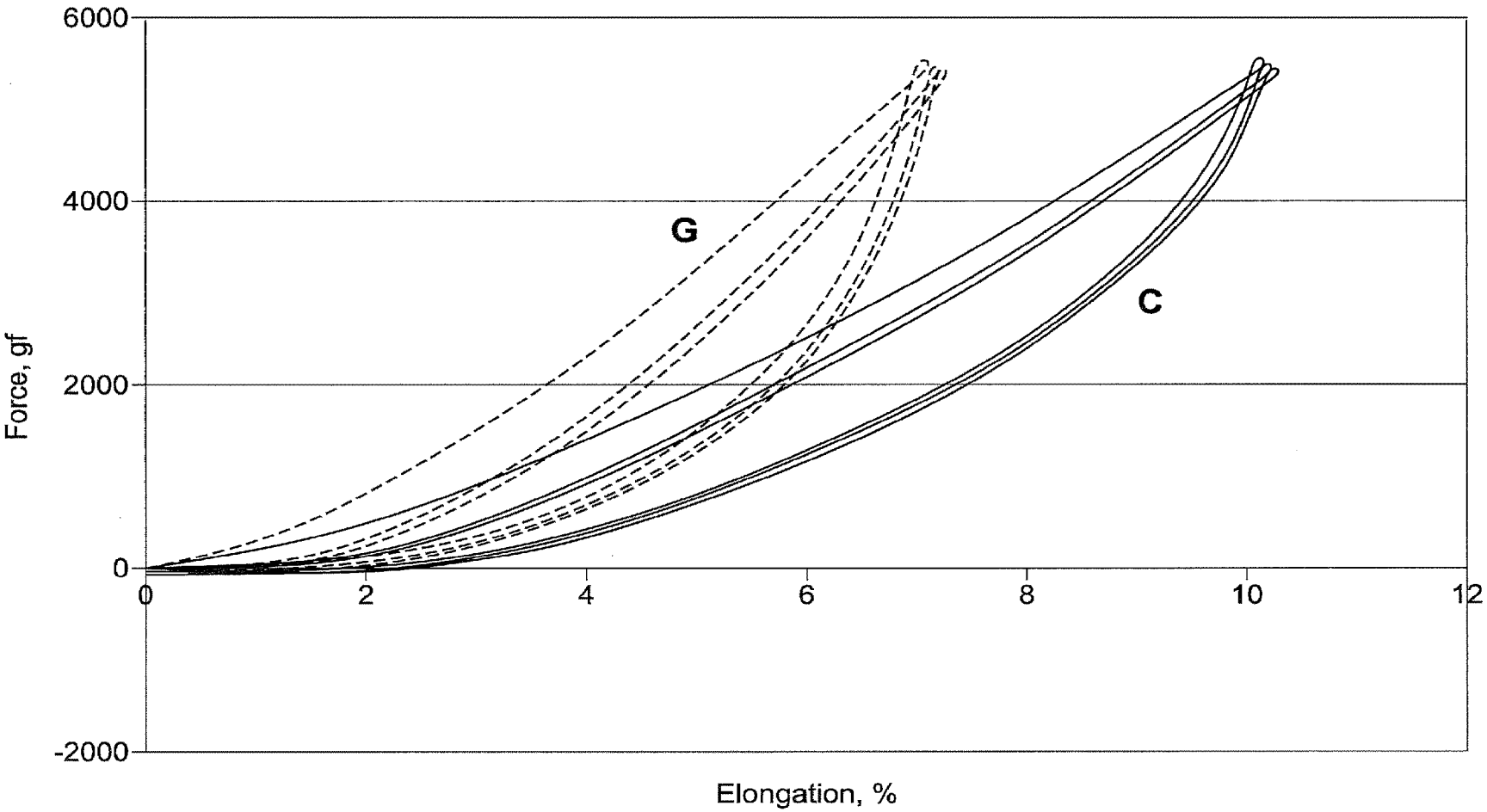
Figure 3:
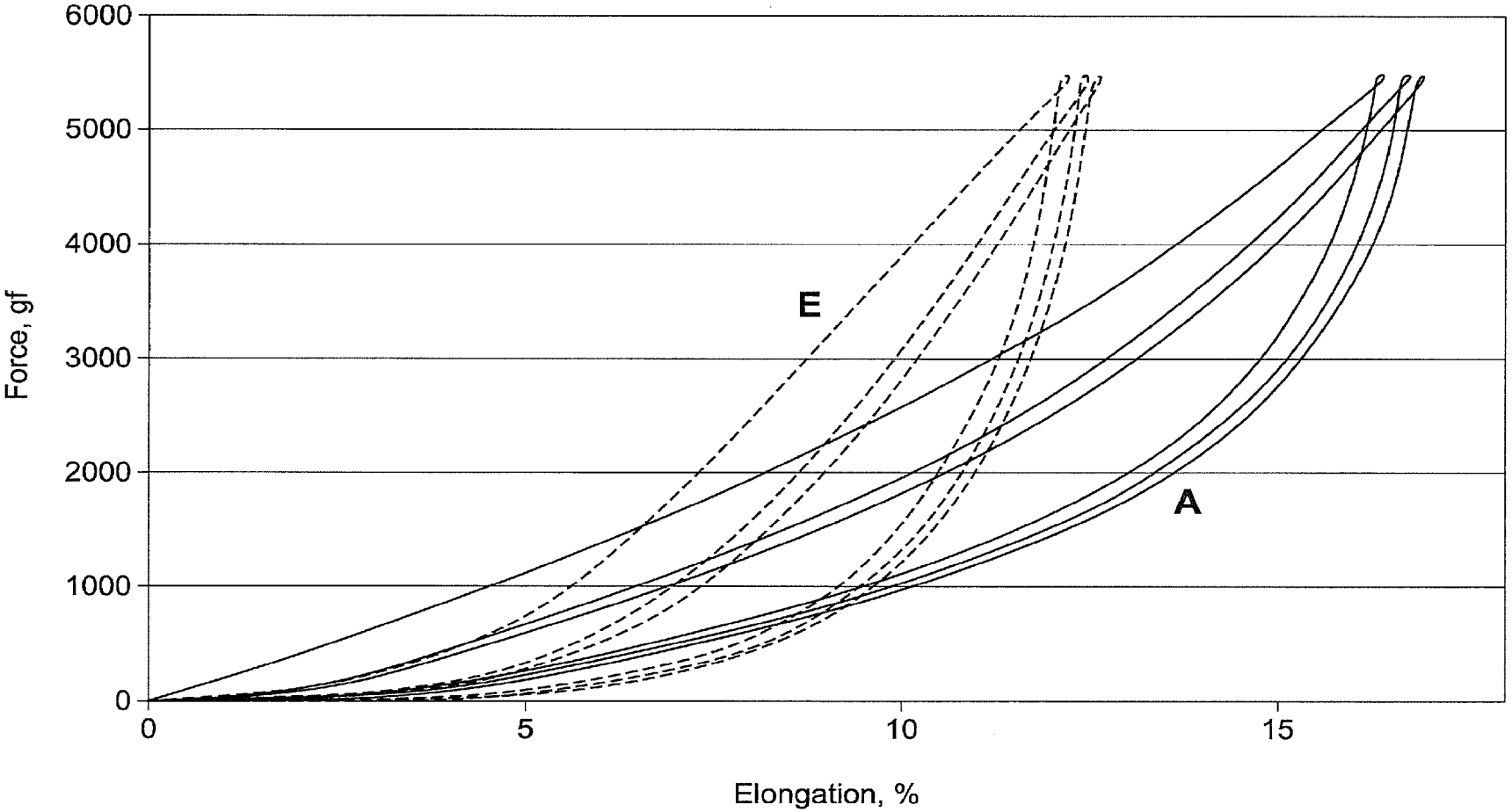

For fabrics that were washed before the waistbands were made, there is still a significant enhancement in stretch potential (elongation at 5450 g) and the unload power for the waistbands. Stress/strain is shown in FIG. 2. For fabrics which were washed subsequently, the improvement is also noticeable as shown in FIG. 3.

Example 5

Testing Description

Properties of hosiery were tested including a multiple layer polyurethaneurea (PUU) film of 10 mil width 7 mil thick. The three layer film included layers of polyurethaneurea cast from dispersion where the polyurethaneurea layers have weight average molecular weight of approximately 70,000, 120,000 and 70,000. The PUU films were applied to white lace after a typical hosiery acid dye protocol and compared these results to this film as applied to the greige fabric prior to dyeing. The same was done for typical commercial silicone film and for plain lace without any film bonded to it.

Samples Preparation

A 6 inch wide by 12 inch length nylon lace fabric was prepared by bonding with two stripes of 10 mil width 7 mil thick multiple layer PUU film (as described above) and applied as follows:

Nylon rachel lace fabric knit by Macra Lace Co. of thickness approximately 25 to 30 mils, basis weight 150 grams per square yard, and 3.5 inch width, as commonly used in the fabrication of thigh high hosiery tops, is used as the substrate. A PUU film of thickness 7 mils and width of 10 mils was applied to inside of the lace so as to touch the skin of a wearing when attached to a hosiery leg. A strip of PUU film on backing paper was positioned on the lace fabric substrate. A hand iron set to 'moderate heat' was used to heat the film through the backing paper to tack the film to the substrate so it could be further transferred to a hot press. The substrate fabric with the film tacked in place was then placed in an MACPI Press/Model #553. 37-9124.00 manufactured by Macpi Group with the garment turned inside out and film strips exposed. Silicone release backing paper was then placed on the bottom and top of the garment, the fabric was hot-pressed at between 160° C. to 170° C. for 30 seconds at a pressure of approximately 72 psi or 5 bar.

For comparison with the inventive fabric, the following fabrics were used:

6 inch wide by 12 inch length nylon lace fabric with two stripes of 10 mil width silicone film applied by commercial vendor 6 inch wide lace fabric only Dye Protocol A standard dyeing/finishing protocol for nylon/Lycra® spandex sheer hosiery was used as follows:

Pre-Scour
Set bath at 100° F.
Add merol HCS 1% and TSPP 0.5%
Run 10 minutes at 100° F.
Raise temperature to 170 degrees @ 3 degree per minute
Overflow rinse
Clear and drain
Dyeing Set bath at 90° F. and add standard dye chemicals as follows:

| | |
|---|---|
| Cevegen 7 | 1.5% |
| Nylanthrene Blue GLF | 0.36% |
| Nylanthrene Orange SLF | 0.685% |
| Nylanthrene Rd 2RDF | 0.130% |

Adjust to pH 7.5 to 8.0 with acetic acid and TSPP
Run 30 minute at 90° F.
Raise to 170 degrees at 3 degrees/minute
Run 30 minutes
Drop bath
Rinse cold 5 minutes Part of the sample is saved at this juncture, and the remainder of the fabric is treated with a fixing agent as follows:

Fix with Cibafix DGF 4%
Adjust pH to 4.5 with acetic acid
Run 20 minutes @ 170F
Dewater
Dry Observations Early testing observations indicated that PUU film was rather high load and hysteresis versus the commercial silicone band of similar dimension We observed some interesting improvements over the incumbent silicone product:

1) PUU film took dye and remained tinted to shade when dyed with dark beige color system providing a better more integrated appearance to the film-on-lace hosiery stay up band
2) PUU film remained bonded to lace substrate with 170° F. max temperature dye protocol
3) Significantly, the film attached to the substrate took on a 'softer stress/strain' property after dyeing which is seen as a positive noting that the pre-dyed greige film-on-lace appeared to have a much steeper s/s property versus the current commercial silicone product system Fastness Check Washfastness was checked with AATCC 2A wash before and after finishing with a fixing agent.

After fixing showed no dye staining on standard sheet fabrics.

The following Table 3 demonstrates advantages of the inventive PUU films. The include dyeability, softening of stretch recovery, improved skin tack friction, as compared to the commercial standard of silicone.

TABLE 3

| Hosiery Articles | | | |
|---|---|---|---|
| Result | 10 PUU film bonded to lace | Silicone incumbent Bonded to lace | Lace only |
| Bond | Bond adhesion remained in tack | Bond adhesion remained in tack | N/A |
| Film Color/Shade | Took on dyed color to light shade | Clear/no dye uptake | Normal dye uptake |
| Stretch Recovery | Softer/Lower power vs not dyed | Same as not-dyed control | Same as greige |
| Skin Tack Friction | Slightly better vs not-dyed | Same as not-dyed | N/A |
| Wash Fastness prefix | Some dye bleed observed | Some dye bleed observed | Some dye bleed observed |
| Wash Fast Rating | No dye bleed after fixing | No dye bleed after fixing | No dye bleed after fix |

While the present invention has been described in an illustrative manner, it should be understood that the terminology used is intended to be in a nature of words or description rather than of limitation. Furthermore, while the present invention has been described in terms of several illustrative embodiments, it is to be appreciated that those skilled in the art will readily apply these teachings to other possible variations of the invention.

What is claimed is:

1. An article comprising a garment having at least one opening;

said opening comprising an elastomeric polymer composition wherein said polymer composition comprises more than one polyurethaneurea layer wherein each polyurethaneurea layer has a different weight average molecular weight, wherein polyurethaneurea layer includes at least one layer of polyurethaneurea having a lower weight average molecular weight from 35,000 to 90,000 and at least one layer of polyurethaneurea having a higher weight average molecular weight from 100,000 to 130,000, further wherein said elastomeric polymer composition comprises a film, dispersion or combinations thereof cast from aqueous polyurethaneurea and said layer of polyurethaneurea having a lower weight average molecular weight contacts said garment.

2. The article of claim 1, wherein said elastomeric polymer composition has at least a two layer configuration including one layer of lower molecular weight and one layer of higher molecular weight or said more than elastomeric polymer composition has at least a three layer configuration having at least one layer of higher molecular weight between two layers having a lower molecular weight.

3. The article of claim 1, wherein said elastomeric polymer composition comprises a film cast from an aqueous polyurethaneurea dispersion.

4. The article of claim 1, wherein said garment comprises hosiery.

5. The article of claim 1, wherein said polyurethaneurea composition is attached to a body-contacting surface of said opening of said garment.

6. The article of claim 1, wherein garment layers are formed by folding a single piece of fabric.

7. The article of claim 1, wherein the elastomeric polyurethaneurea composition extends throughout the entire area of the opening.

8. The article of claim 1, wherein the elastomeric polyurethaneurea composition extends to a portion of the area of the opening.

9. The article of claim 1, wherein said elastomeric polyurethaneurea composition comprises a porous film.

10. The article of claim 1, wherein said elastomeric polyurethaneurea composition comprises a perforated film.

11. The article of claim 1, further comprising an adhesive between said elastic polyurethaneurea composition and said garment.

12. The article of claim 11, wherein the adhesive comprises a discontinuous application.

13. The article of claim 12, wherein said discontinuous application is selected from the group consisting of dots, vertical lines, horizontal lines, diagonal lines, a grid, and combinations thereof.

14. The article of claim 11, wherein said adhesive is selected from the group consisting of a hot melt adhesive, a cyanoacrylate, an epoxy, polyvinyl acetate, a plastisol, a thermoplastic, silicone, a polyurethaneurea aqueous dispersion, and combinations thereof.

15. The article of claim 1, wherein said edgeband includes a woven fabric cut on the bias.

16. The article of claim 1, wherein said garment is selected from the group consisting of tops, bottoms, hosiery, seamless garments, headwear, underwear, and gloves.

17. The article of claim 1, wherein said opening is an edgeband.

18. The article of claim 17, wherein said edgeband is selected from the group consisting of an armband, a cuff, a collar, a waistband, a legband, and a headband.

19. The article of claim 17, wherein said edgeband is a waistband.

20. The article of claim 17, wherein said elastomeric polymer composition is included within an edgeband.

21. The article of claim 20, wherein said edgeband includes two or more garment layers and said elastomeric polymer composition is located between said garment layers.

* * * * *